US007823364B2

(12) United States Patent
Elliott

(10) Patent No.: US 7,823,364 B2
(45) Date of Patent: Nov. 2, 2010

(54) FIRE-RETARDANT CEMENTITIOUS SHEAR BOARD HAVING METAL BACKING WITH TAB FOR USE AS UNDERLAYMENT PANEL FOR FLOOR OR ROOF

(75) Inventor: A. Carleton Elliott, Newport Beach, CA (US)

(73) Assignee: Specialty Hardware L.P., Newport Beach, CA (US)

( * ) Notice: Subject to any disclaimer, the term of this patent is extended or adjusted under 35 U.S.C. 154(b) by 0 days.

(21) Appl. No.: 12/763,586

(22) Filed: Apr. 20, 2010

(65) Prior Publication Data

US 2010/0192510 A1 Aug. 5, 2010

Related U.S. Application Data

(62) Division of application No. 11/162,149, filed on Aug. 30, 2005, now Pat. No. 7,770,346.

(51) Int. Cl.
*E04G 21/00* (2006.01)
*E04B 1/00* (2006.01)
*E04G 23/00* (2006.01)

(52) U.S. Cl. ..... 52/745.05; 52/309.12; 52/309.14; 52/309.17; 52/438; 52/415

(58) Field of Classification Search ..... 52/745.05, 52/367, 415, 438, 442, 440, 449, 309.9, 309.12, 52/309.14, 309.17
See application file for complete search history.

(56) References Cited

U.S. PATENT DOCUMENTS 1,484,175 A 2/1924 Elmendorf
1,659,539 A 2/1928 Judson
3,408,784 A 11/1968 Crowley (Continued)

FOREIGN PATENT DOCUMENTS

CH 612239 7/1979

OTHER PUBLICATIONS

Cem-Steel, Datasheet [online], U.S. Architectural Products, Inc., Jul. 10, 2004. [retrieved on Sep. 16, 2005 at the following internet address <URL: http://architecturalproducts.com/cemsteel.htm>], 62 pages.

(Continued)

*Primary Examiner*—Richard E Chilcot, Jr.
*Assistant Examiner*—Chi Nguyen
(74) *Attorney, Agent, or Firm*—Jerry Turner Sewell

(57) ABSTRACT

A shear panel for constructing underlayments for floors and roofs of buildings includes a first rectangular layer of fire-resistant material, such as cementitious board, bonded to a second rectangular layer of thin high-strength material, such as galvanized steel. The length of the second layer is longer than the length of the first layer. The additional length of the second layer forms a tab extending from one end of the panel. During construction, a first panel is attached to a set of beams (floor joists or roof rafters) with the tab spanning between adjacent beams. A second panel is positioned on the beams with at least a portion of the second panel overlapping the tab of the first panel. The overlapping portion of the second panel is fastened to the tab of the first panel to form a continuous shear diaphragm for the floor or roof.

5 Claims, 8 Drawing Sheets

U.S. PATENT DOCUMENTS

| | | | | |
|---|---|---|---|---|
| 3,919,443 | A | | 11/1975 | Porter |
| 4,015,386 | A | | 4/1977 | Cook |
| 4,016,697 | A | | 4/1977 | Ericson |
| 4,024,684 | A | | 5/1977 | Holmgren |
| 4,122,203 | A | | 10/1978 | Stahl |
| 4,203,788 | A | | 5/1980 | Clear |
| 4,206,267 | A | | 6/1980 | Jungbluth |
| 4,241,555 | A | | 12/1980 | Dickens et al. |
| 4,263,752 | A | | 4/1981 | Jungbluth |
| 4,284,447 | A | | 8/1981 | Dickens et al. |
| 4,435,934 | A | | 3/1984 | Kim |
| 4,494,348 | A | | 1/1985 | Kastelic |
| 4,646,498 | A | | 3/1987 | Schneller et al. |
| 4,704,837 | A | | 11/1987 | Menchetti et al. |
| 4,774,794 | A | | 10/1988 | Grieb |
| 4,869,037 | A | | 9/1989 | Murphy |
| 4,918,897 | A | | 4/1990 | Luedtke |
| 4,936,070 | A | | 6/1990 | Michaud |
| 5,001,879 | A | | 3/1991 | Paliwoda |
| 5,002,620 | A | | 3/1991 | King |
| 5,048,257 | A | | 9/1991 | Luedtke |
| 5,050,362 | A | | 9/1991 | Tal et al. |
| 5,143,670 | A | | 9/1992 | De Buzzaccarini |
| 5,285,609 | A | | 2/1994 | Goad |
| 5,349,796 | A | | 9/1994 | Meyerson |
| 5,402,615 | A | | 4/1995 | Knott et al. |
| 5,448,866 | A | | 9/1995 | Saito et al. |
| 5,473,849 | A | | 12/1995 | Jones, Jr. et al. |
| 5,483,778 | A | | 1/1996 | Scrivener |
| 5,612,111 | A | * | 3/1997 | Lin ..... 428/71 |
| 5,673,524 | A | * | 10/1997 | Gailey ..... 52/309.9 |
| 5,768,841 | A | | 6/1998 | Swartz et al. |
| 5,834,082 | A | | 11/1998 | Day |
| 5,927,032 | A | | 7/1999 | Record |
| 6,000,194 | A | | 12/1999 | Nakamura |
| 6,061,993 | A | | 5/2000 | Bendixen et al. |
| 6,085,484 | A | | 7/2000 | Ban |
| 6,085,485 | A | | 7/2000 | Murdock |
| 6,119,422 | A | | 9/2000 | Clear et al. |
| 6,256,960 | B1 | | 7/2001 | Babcock et al. |
| 6,385,942 | B1 | | 5/2002 | Grossman et al. |
| 6,412,247 | B1 | | 7/2002 | Menchetti et al. |
| 6,415,573 | B1 | | 7/2002 | Moulder |
| 6,463,702 | B1 | | 10/2002 | Weaver et al. |
| 6,588,171 | B2 | | 7/2003 | Pryor et al. |
| 6,619,006 | B1 | | 9/2003 | Shirota |
| 6,901,713 | B2 | | 6/2005 | Axsom |
| 6,913,819 | B2 | | 7/2005 | Wallner |
| 6,941,720 | B2 | | 9/2005 | DeFord et al. |
| 7,051,485 | B2 | * | 5/2006 | Burnette ..... 52/578 |
| 7,770,346 | B2 | * | 8/2010 | Elliott ..... 52/415 |

OTHER PUBLICATIONS

Chilcot, Richard, "Written Opinion of the International Searching Authority," Form PCT/ISA/237, for International Application No. PCT/US2006/033588, Nov. 8, 2007, (3 pages), which is an attachment to Lindner, Nora, "International Preliminary Report on Patentability," Form PCT/IB/373, Jul. 21, 2009, 4 pages total.

* cited by examiner

FIRE-RETARDANT CEMENTITIOUS SHEAR BOARD HAVING METAL BACKING WITH TAB FOR USE AS UNDERLAYMENT PANEL FOR FLOOR OR ROOF

BACKGROUND OF THE INVENTION

1. Field of the Invention

The present invention is related to fire-retardant panels for building construction, and, more particularly, is related to panels that are interconnected to form a continuous fire-resistant diaphragm for a floor or a roof of a building.

2. Description of the Related Art

Prevention of fires is an important aspect of building construction and use; however, fires do occur within buildings, and is important that any such fire be confined so that the fire does not spread throughout the building. Since flames and heat from combustion tend to expand upwardly, it is particularly important to inhibit or retard the spread of a fire between floors and to inhibit or retard a fire from penetrating the roof and spreading to other structures.

Various techniques have developed for reducing the spread of fire, particularly with respect to high-rise buildings. For example, the floors of such buildings may comprise a layer of corrugated metal with a layer of concrete poured over the metal. The beams supporting such floors are generally heavy steel I-beams, or the like, with sprayed-on fire retardant material. Typically, the space between the ceiling of one story of the building and the floor of the next higher story is a significant percentage of the height of each story. Because of the weight of such structures and because of the equipment required to erect such structures, such techniques are not economically or mechanically practical for smaller buildings having one to a few stories, such as, for example, smaller office buildings, condominiums, apartments, and the like, which are generally constructed using more manual labor and less large equipment. Furthermore, the amount of extra space needed to accommodate the covered beams and thick floor may result in unacceptably tall building.

Other techniques used for construction of smaller buildings require the construction crews to perform additional steps. For example, rather than simply laying down underlayment panels on the beams (e.g., floor joists or roof rafters) of a building, the construction crew may lay down a pattern of fire-retardant strips before laying down the panels. The strips cover the gaps between adjacent panels so that flames or heat from a fire do not penetrate the gaps. The additional material and labor required to align and install the strips increase the cost of constructing the building.

In addition to retarding of the vertical spread of fire, underlayment panels attached to support beams are used to provide shear resistance capacity that substantially reduces the lateral shifting of a building during earthquakes, high winds and other events that exert significant forces on the building. The fire-resistant material used to retard the spread of fire is generally not suitable for providing shear resistance capacity. Thus, additional construction steps are needed to provide both fire-resistance and shear resistance capacity.

SUMMARY OF THE INVENTION

In view of the foregoing, a need exists for improvements in the techniques for reducing the vertical spread of fire through the floors and through the roof of a building. Furthermore, a need exists for improvements in providing shear resistance capacity to the floors and roof of a building In accordance with aspects of embodiments of the present invention, a shear panel for floors and roofs provides improved fire retardation and improved shear resistance capacity. The shear panel comprises a fire-resistant material bonded to a thin high-strength backing material (e.g., a metal such as, for example, galvanized steel). The shear panel is generally rectangular, and has a width defined between first and second edges and has a length defined between third and fourth edges. The width of the panel is selected so that when the panel is placed on conventionally spaced support beams (e.g., floor joists or roofing rafters spaced on 16-inch (40.64-centimeter) or 24-inch (60.96-centimeter) centers) with the first edge aligned with the centerline of a beam, the second edge is also aligned with the centerline of a parallel beam. In particularly preferred embodiments, the width is 48 inches (121.192 centimeters). When the first edge of a first panel is abutted to the second edge of an adjacent second panel along a beam, the seam formed between the two panels is blocked by the beam, thus creating a continuous fire retardant barrier across the seam when the two panels are secured to the beam.

The metal backing is continuous between the first and second opposing edges of the panel. The metal backing is also continuous between the third and fourth edges; however, the metal backing extends beyond the fourth edge to form a metallic tab along the fourth edge. When a third edge of a third panel is positioned proximate to the fourth edge of the first panel, a portion of the third panel proximate to the third edge overlies and rests upon the tab of the first panel. The third panel is secured to the tab of the first panel to close the seam between the two panels and form a fire retardant barrier in the space between the beams spanned by the two panels.

An aspect in accordance with embodiments of the present invention is a shear panel for floors and roofs that comprises a first layer of generally planar fire-resistant material, a second layer of high-strength backing material, and a bonding layer interposed between the first layer and the second layer to secure the second layer to the first layer. The first layer has a first surface and a second surface, which are generally rectangular. The shape of the first layer is defined by a first width between a first edge and a second edge of the second surface and by a first length defined between a third edge and a fourth edge of the second surface. The backing material has a generally rectangular shape. The shape of the backing material is defined by a second width between a respective first edge and a respective second edge of the second layer and by a second length between a respective third edge and a respective fourth edge of the second layer. The second width of the second layer is approximately equal to the first width of the first layer. The second length of the second layer is greater than the first length of the first layer by a selected distance. The first edge of the second layer is aligned with the first edge of the first layer. The second edge of the second layer is aligned with the second edge of the first layer. The third edge of the second layer is aligned with the third edge of the first layer. The fourth edge of the second layer is displaced from the fourth edge of the second layer by the selected distance to form a tab extending from the third edge of the first layer.

Another aspect in accordance with embodiments of the present invention is a shear panel for floors and roofs that comprises a generally rectangular first layer and a generally rectangular second layer bonded to the first layer. The first layer comprises a fire-resistant material. The second layer comprises a high-strength backing material. The first layer has a first width between respective first and second edges and has a first length between respective third and fourth edges. The second layer has a second width between respective first and second edges and has a second length between respective third and fourth edges. The second width is approximately the same as the first width, and the second length is greater than the first length by a tab length. The backing material is positioned on the first layer with the respective first edges aligned, with the respective second edges aligned, and with the respective third edges aligned. When the first, second and third edges are aligned, the fourth edge of the second layer is displaced from the fourth edge of the first layer by the tab length. The additional length of the backing material extends as a tab from the fourth edge of the first layer.

Another aspect in accordance with embodiments of the present invention is a method of forming a laminated shear panel for constructing floors and roofs of a building. The method comprises forming a first layer of a fire-resistant material into a first generally rectangular shape having a first width between a respective first edge and a respective second edge and having a first length between a respective third edge and a respective fourth edge. The method further comprises forming a second layer of a high-strength material into a second generally rectangular shape having a second width between a respective first edge and a respective second edge and having a second length between a respective third edge and a respective fourth edge. In accordance with the method, the second width is formed to be approximately the same as the first width, and the second length is formed to be greater than the first length by a tab length. The method further includes aligning the first edge of the second layer with the first edge of the first layer and aligning the second edge of the second layer with the second edge of the first layer. The method further includes aligning the third edge of the second layer with the third edge of the first layer to cause the fourth edge of the second layer to be displaced from the fourth edge of the first layer by the tab length. The method further includes bonding the first layer to the second layer to produce a laminated panel.

Another aspect in accordance with embodiments of the present invention is a method for constructing a fire-resistant and shear-resistant diaphragm on the floor or roof of a building. The method comprises positioning a first rectangular shear panel on a first set of at least three beams. The first shear panel has a width selected to correspond to a multiple of a center-to-center spacing of the beams. The first shear panel comprises a layer of fire-resistant material bonded to a layer of high-strength material. The layer of fire-resistant material has a first length between a first edge and a second edge. The layer of high-strength material has second length greater than the first length to form a tab proximate the second edge of the shear panel. The method further includes positioning a second rectangular shear panel substantially identical to the first rectangular shear panel on a second set of at least three beams. At least two of the beams of the second set of beams are also in the first set of beams. At least an overlapping portion of the second shear panel proximate to the first edge is positioned on the tab of the first shear panel. The method further includes securing the first shear panel to the first set of beams, and securing the overlapping portion of the second shear panel to the tab of the first shear panel.

Another aspect in accordance with embodiments of the present invention is a shear panel for constructing underlayments for floors and roofs of buildings. The shear panel includes a first rectangular layer of fire-resistant material, such as cementitious board. The first layer is bonded to a second rectangular layer of thin high-strength material, such as galvanized steel. The length of the second layer is longer than the length of the first layer. The additional length of the second layer forms a tab extending from one end of the panel. During construction, a first panel is attached to a set of beams (floor joists or roof rafters) with the tab spanning between adjacent beams. A second panel is positioned on the beams with at least a portion of the second panel overlapping the tab of the first panel. The overlapping portion of the second panel is fastened to the tab of the first panel to form a continuous shear diaphragm for the floor or roof.

BRIEF DESCRIPTION OF DRAWINGS

The foregoing aspects and other features of embodiments in accordance with the present invention are described in more detail below in connection with the attached set of drawings in which.

DETAILED DESCRIPTION OF PREFERRED EMBODIMENTS

Figure 1:
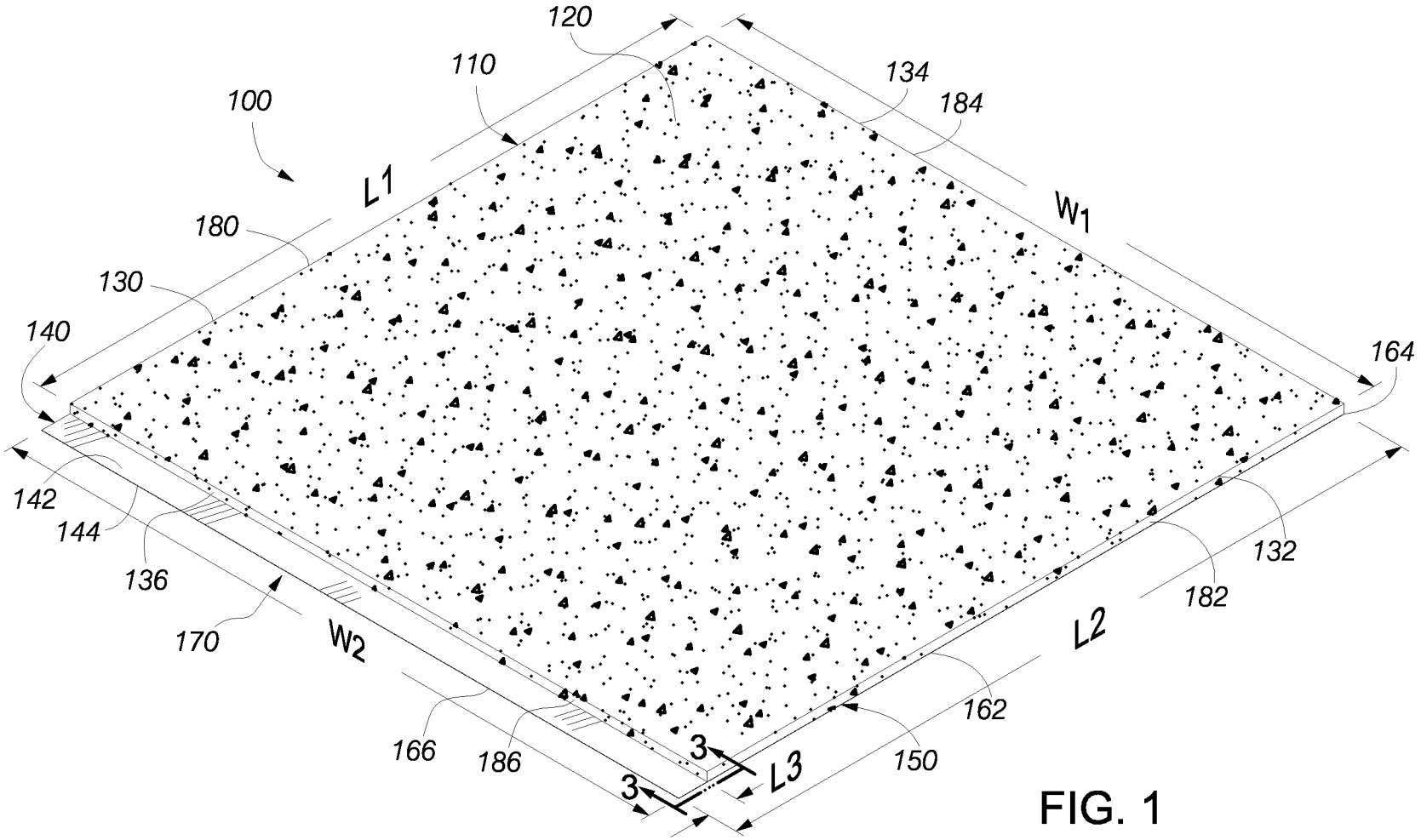
FIG. 1 illustrates a perspective view of an exemplary shear panel in accordance with the present invention.
Figure 2:
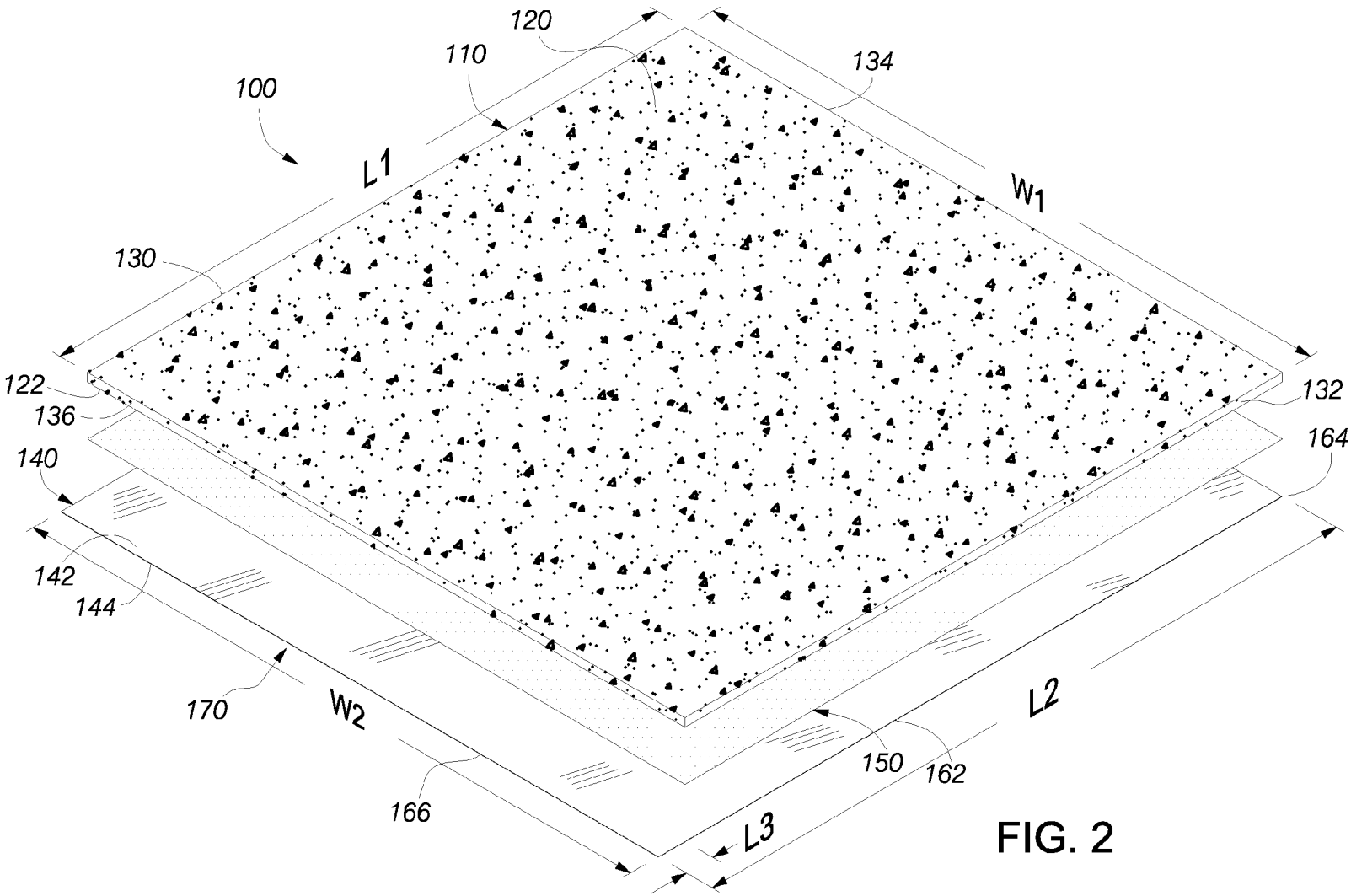
FIG. 2 illustrates an exploded perspective view of the panel of FIG. 1 showing the two layers of the panel prior to bonding.
Figure 3:
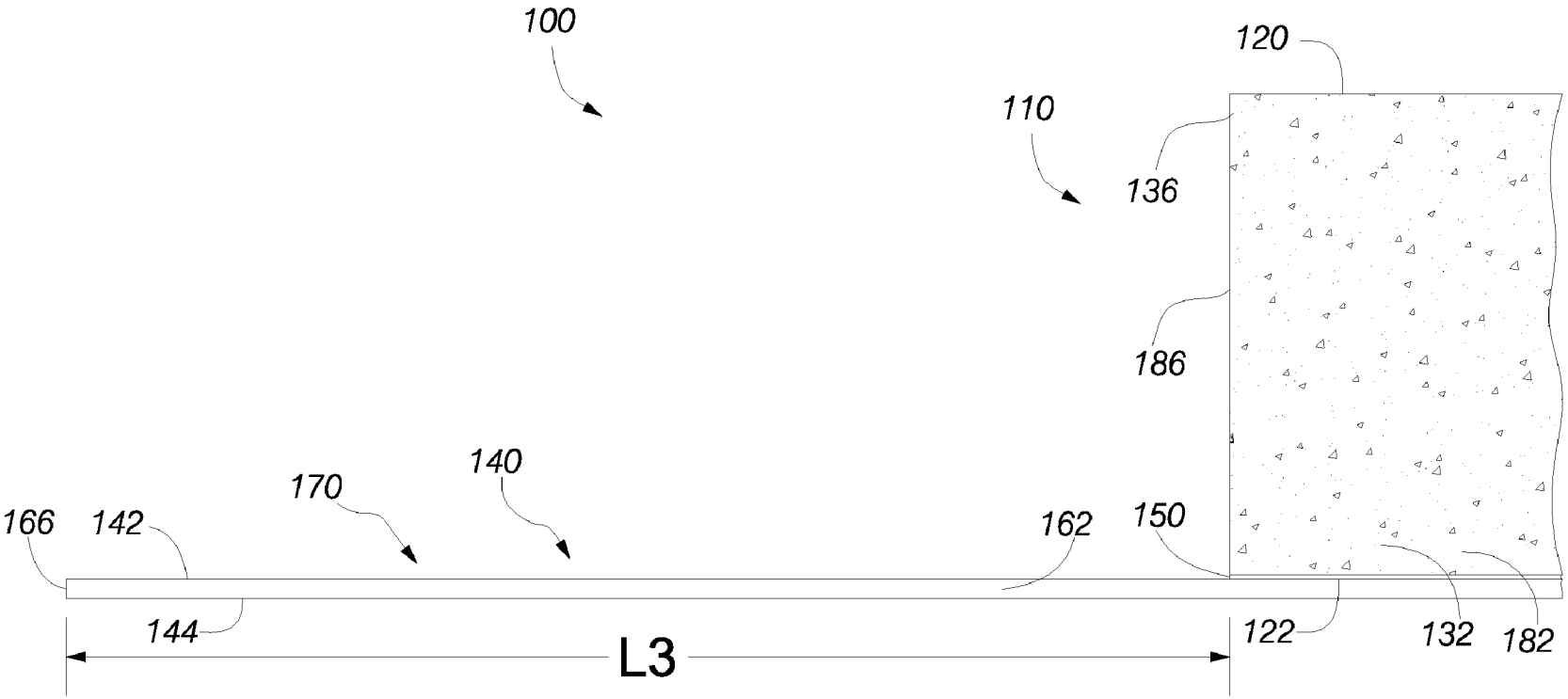
FIG. 3 illustrates an enlarged elevational view of the panel of FIG. 1 in the direction of the lines 3-3 in FIG. 1.

FIGS. 1, 2 and 3 illustrate an exemplary panel 100 in accordance with aspects of the present invention. The panel 100 is a laminated panel that comprises a first layer 110 of fire-resistant material, such as, for example, a cementitious material. For example, in certain embodiments, the first layer 110 comprises a non-combustible material such as Durock® brand underlayment available from USG Corporation headquartered in Chicago, Ill.; PermaBase® brand cement board available from National Gypsum Company headquartered in Charlotte, N.C.; and Hardiebacker 500® brand cement backerboard available from James Hardie Building Products in Mission Viejo, Calif. Other cement boards and boards comprising other non-combustible materials may also be used.

The first layer 110 has top surface 120 and a bottom surface 122 (FIG. 2). In preferred embodiments, the first layer 110 has a thickness defined between the top surface 120 and the bottom surface 122 in a range from 0.5 inch (1.27 centimeters) to 1 inch (2.54 centimeters). Preferably, the thickness of the first layer 110 is a standard thickness for the building construction industry (e.g., 0.625 inch (1.59 centimeters) or 0.75 inch (1.9 centimeters)).

The shape of the first layer 110 is defined by the generally rectangular shapes of the top surface 120 and the bottom surface 122. The first layer 110 has a width W1 defined between a first edge 130 and a parallel second edge 132. The first layer 110 has a length L1 defined between a third edge 134 and a parallel fourth edge 136. The width W1 and the length W2 are selected so that the panel 100 is sized to be compatible with the size of conventional 4×8 sheeting material used for building construction (e.g., a width of 4 feet (121.192 centimeters) and a length of eight feet (243.84 centimeters)). Although the panel 100 can be formed as a full 4×8 sheet, the weight of the cementitious material used for the first layer 110 may be 200-250 pounds (90.7-113.4 kilograms) for a 4×8 sheet having a thickness of approximately 0.625-0.75 inch (1.59-1.9 centimeters). Two or more construction workers may be needed to position each panel 100 during construction. In order to facilitate handling, the first layer 110 is configured as a square having a width W1 of 4 feet (121.192 centimeters) and a length L1 of 4 feet (121.192 centimeters) in the preferred embodiment of the panel 100 illustrated in FIG. 1. Thus, the weight of the first layer 110 in the illustrated embodiment is approximately 100-125 pounds (45.36-56.7 kilograms).

The cementitious material or other fire-resistant material used for the first layer 110 is generally quite brittle. Thus, the first layer 110 would not support a substantial load if the layer 110 were used alone to span between two beams (e.g., floor joists or roof rafters). Thus, as further illustrated in FIG. 1, and as shown more clearly in the exploded perspective view of FIG. 2, the panel 100 further comprises a second layer 140 that is bonded to the bottom surface 122 of the first layer 110. The second layer 140 advantageously comprises a thin sheet of high-strength material, such as, for example, galvanized steel. Preferably, the second layer 140 has a thickness in a range from approximately 0.01 inch (0.254 millimeter) to approximately 0.1 inch (2.54 millimeters). More preferably, the second layer 140 has a thickness between a top surface 142 and a bottom surface 144 in a range from approximately 0.015 inch (0.381 millimeter) to approximately 0.06 inch (1.524 millimeters). In the illustrated embodiment, the second layer has a thickness of approximately 0.03 inch (0.762 millimeter), which generally corresponds to 22-gage. Although described herein as comprising galvanized steel, other suitable high strength materials may also be used.

In certain preferred embodiments, the second layer 140 is bonded to the first layer 110 in accordance with the method disclosed, for example, in U.S. Pat. No. 5,768,841 to Swartz et al. for Wallboard Structure. Preferably, the second layer 140 is bonded to the first layer 110 using a layer 150 of a suitable bonding material. Preferably, the bonding layer 150 comprises an adhesive, such as, for example, epoxy, glue, or the like. The adhesive is advantageously sprayed, brushed or rolled onto the bottom surface 122 of the first layer 110 or onto the top surface 142 of the second layer 140 or onto both in a conventional manner. The two surfaces are then forced together to permanently engage the two surfaces. Alternatively, the two surfaces can be bonded using double-sided tape or other suitable materials as the bonding layer 150. The bonding layer 150 is illustrated in FIG. 2 as being a separate layer spaced apart from the other two layers, such as in an embodiment utilizing double-sided tape or other sheets of adhesive material. In embodiments where the bonding layer 150 comprises an applied adhesive, the bonding layer 150 is only present as material applied to one of the other layers.

After the bonding is completed, the first layer 110, the bonding layer 150 and the second layer 140 form the laminated panel 100. FIG. 3 illustrates an enlarged elevational view of a portion of the laminated panel 100 in the direction of the lines 3-3 in FIG. 1 to show the laminated layers in more detail.

The laminated panel 100 has fire-resistant properties provided by the cementitious first layer 110 and has shear resistant properties provided by the high-strength second layer 140. When installed on beams (e.g., floor joists or roof rafters), as described below, the second layer 140 also enables the panel 100 to span between beams and to support a load without breaking.

As shown in FIG. 2, the top surface 142 and the bottom surface 144 of the second layer 140 also have a generally rectangular shape. The second layer 140 has a width W2 defined between a first edge 160 and a parallel second edge 162. The second layer 140 has a length L2 defined between a third edge 164 and a fourth edge 166. The width W2 of the second layer 140 is substantially the same as the width W1 of the first layer 110 so that the respective first edges 130, 160 and the respective second edges 132, 162 are aligned when the two layers are bonded together as shown in FIG. 1. The length L2 of the second layer 140 is greater than the length L1 of the first layer 110. When the third edge 164 of the second layer 140 is aligned with the third edge 134 of the first layer 110, the fourth edge 166 of the second layer 140 extends beyond the fourth edge 136 of the first layer 110 to form a tab 170. The tab 170 has a length L3 corresponding to the difference in the second length L2 and the second length L1 (e.g., L3=L2−L1). Preferably, the tab 170 extends along the entire width W1 of the fourth edge 136 of the first layer 110. In the illustrated embodiment, the length L2 of the second layer 140 is in a range of approximately 4 feet 1 inch (124.46 centimeters) to approximately 4 feet 2 inches (127 centimeters). Thus, the tab 170 has a length L3 in a range of approximately 1 inch (2.54 centimeters) to approximately 2 inches (5.08 centimeters). As described below, the tab 170 is used to interconnect adjacent panels in a structure to produce a continuous, fire-resistant and shear resistant diaphragm for a floor or a roof.

The first edges 130, 160 of the two layers 110, 140 in the laminated panel form a first edge 180 of the panel 100. The second edges 132, 162 form a second edge 182 of the panel 100. The third edges 134, 164 form a third edge 184 of the panel 100. The fourth edge 136 of the first layer 110 corresponds to a fourth edge 186 of the panel 100. Hence, the tab 170 extends from the fourth edge 186 of the panel 100.

Figure 4:
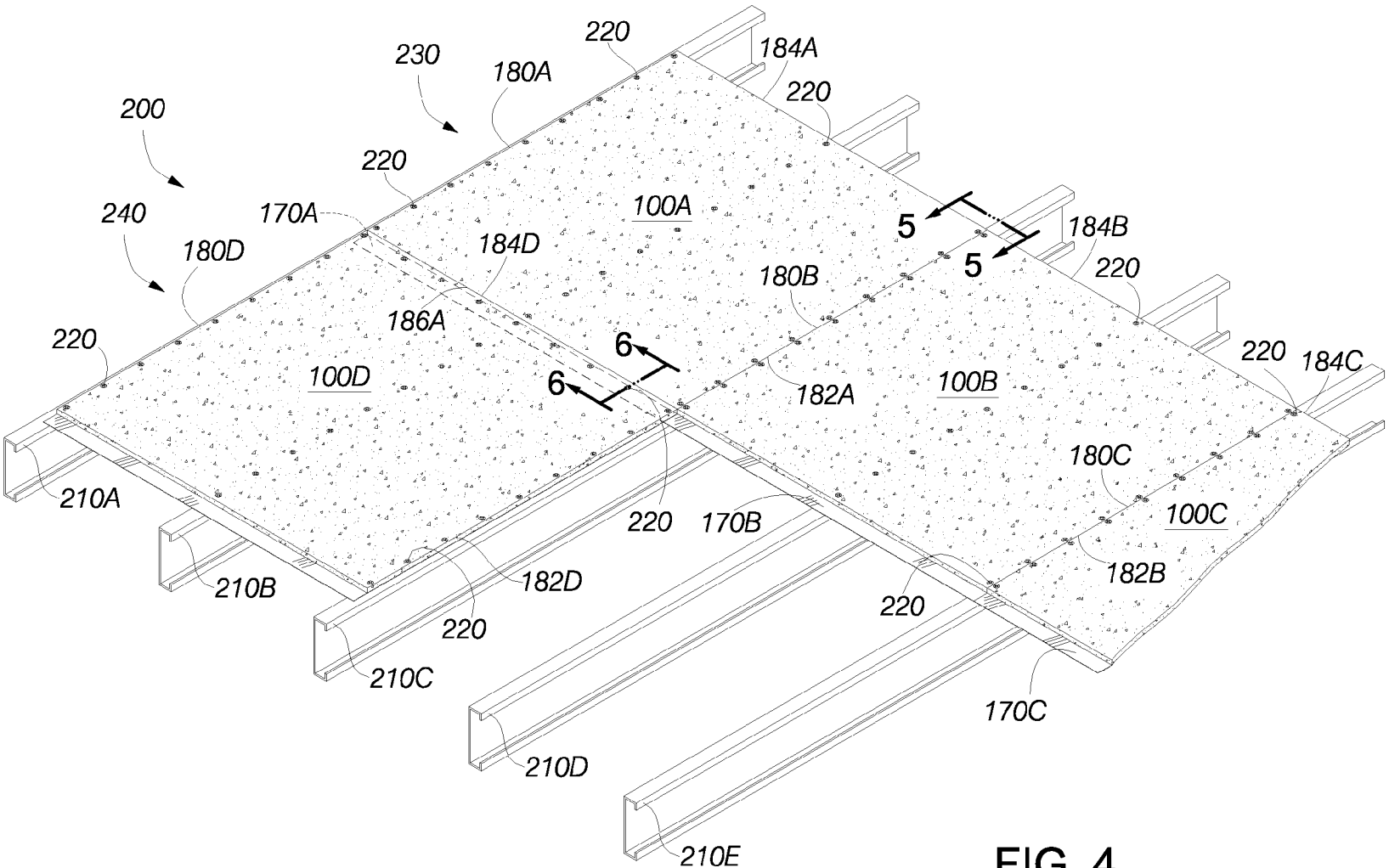
FIG. 4 illustrates a perspective view of an exemplary floor or roof of a building under construction, which illustrates a plurality of the panels of FIG. 1 positioned on support beams (e.g., floor joists or roof rafters) in a first pattern in which the seams between the panels in the longitudinal direction of the beams are aligned and in which the seams in a direction perpendicular to the beams are also aligned.

FIG. 4 illustrates a perspective view of an exemplary floor or roof of a building under construction, which illustrates a plurality of the panels 100 of FIG. 1 positioned on a plurality of beams (floor joists or roof rafters) 210 in a first pattern 200. Although the following description refers to the installation of the panels on a level pattern of beams, such as floor joists or the beams of a flat roof, it is understood that the description is equally applicable to installation of the panels on the rafters of a pitched roof.

In FIG. 4, the beams 210 are oriented longitudinally to form a horizontal flooring plane or a horizontal or pitched roofing plane. The centerlines of the beams 210 are mutually parallel and are spaced apart in the illustrated embodiment by 2 feet (60.96 centimeters) in a conventional manner. One skilled in the art will appreciate that in other construction applications, the centerlines of the beams 210 are spaced apart by 16 inches (40.64 centimeters). As discussed above, the width of the panels 100 accommodates both center-to-center distances. The beams 210 advantageously comprise steel or other suitable construction material. In the illustrated embodiment, the beams 210 have generally C-shaped cross sections with a width of approximately 2 inches (5.08 centimeters) and a height of approximately 8 inches (20.32 centimeters). Beams having other sizes and other cross sections can also be advantageously used in accordance with construction requirements.

As illustrated in FIG. 4, a first panel 100A is positioned with its first edge 180A on a first beam 210A. The middle of the first panel 100A rests on an adjacent beam 210B. The second edge 182A of the first panel 110A rests on a next adjacent third beam 210C. The second edge 182A is aligned approximately with the centerline of the top of the third beam 210C so that the first panel 110A covers approximately a first half of the width of the third beam 210C. For example, in an embodiment where the third beam 210C has a nominal width of 2 inches (5.08 centimeters), the first panel covers approximately one inch (2.54 centimeters) of the width of the third beam 210C.

A second panel 100B is positioned next to the first panel 100A so that the first edge 180B of the second panel 100B abuts the second edge 182A of the first panel 100A and so that the second panel 100B rests on the second half of the top surface of the third beam 210C. The abutment of the two panels 100A, 110B is shown in more detail in the enlarged elevational view in FIG. 5.

Figure 5:
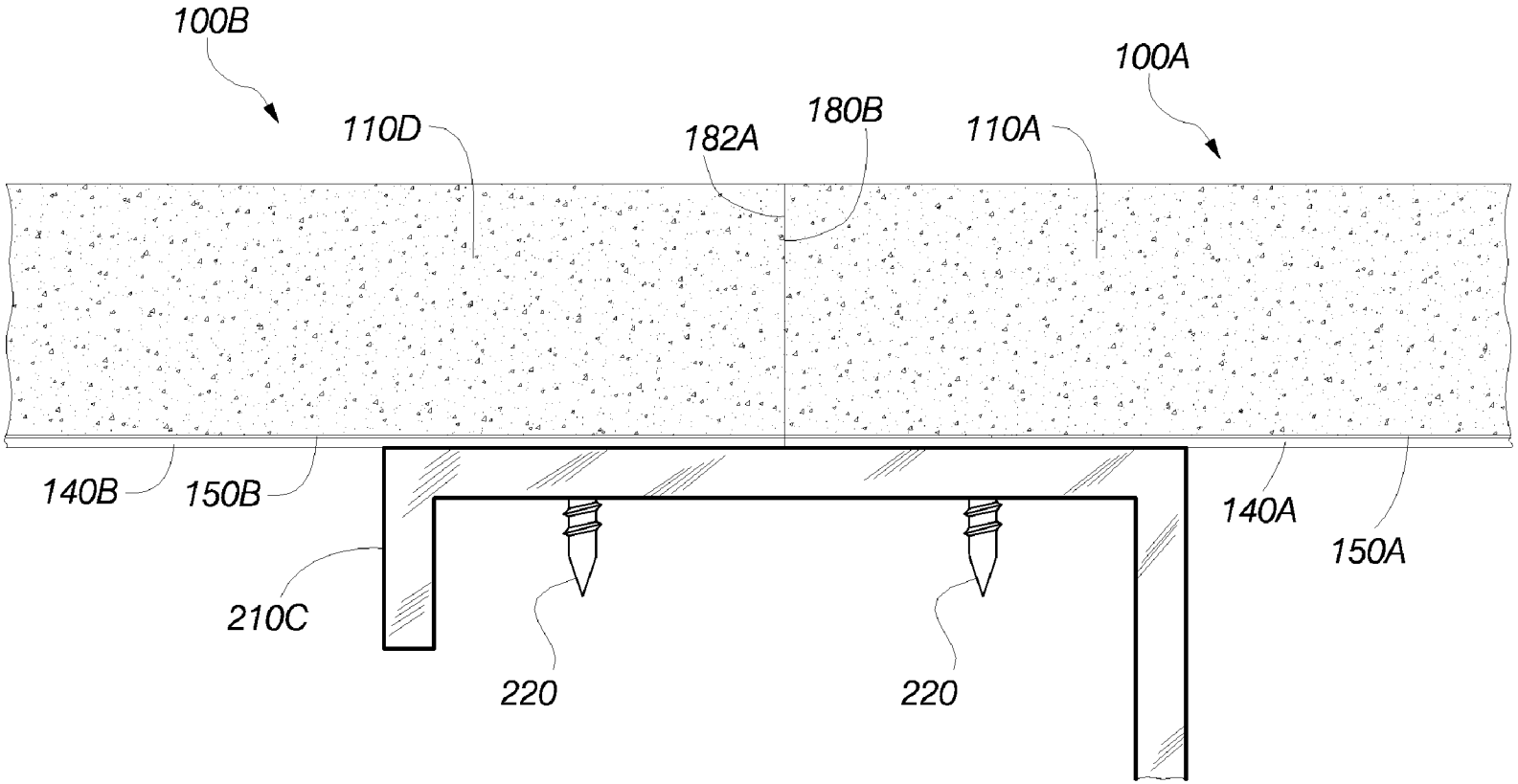
FIG. 5 illustrates an enlarged elevational view taken along the lines 5-5 in FIG. 4 to illustrate the abutment of two adjacent panels along the top of a beam.

As shown in FIG. 5, the two panels 100A, 100B are secured to the third beam 210C by a plurality of suitable fastening devices 220, such as for example, sheet metal screws, which pass through the respective first layers 110A, 110B and through the respect second layers 140A, 140B of the two panels to engage the top of the third beam 210C. Additional fastening devices 220 secure the first panel 100A to the first beam 210A and the second beam 210B.

The middle of the second panel 100B is secured to a fourth beam 210D. The portion of the second panel 100B proximate to its second edge 182B is secured to the first half of a fifth beam 210E. Additional panels 100 are positioned in like manner in alignment with the panels 100A and 100B to form a first row 230 of panels in the pattern of panels. For example, a portion of a third panel 100C is illustrated in FIG. 4 with its first edge 180C abutting the second edge 182B of the second panel 100B. In the pattern illustrated in FIG. 4, the respective third edges 184A, 184B, 184C of the panels 100A, 100B, 100C are substantially aligned in a direction perpendicular to the longitudinal orientation of the beams 210. Similarly, the respective fourth edges 186A, 1868, 186C are aligned in a direction perpendicular to the longitudinal orientation of the beams.

As further illustrated in FIG. 4, a second row 240 of panels 100 is positioned proximate the first row 230. A fourth panel 100D in the second row 240 has its first edge 180D positioned on the first beam 210A in alignment with the first edge 180A of the first panel 100A along the length of the first beam 210A. The middle of the fourth panel 100D rests on the second beam 2108. The second edge 182D of the fourth panel 100D rests on the third beam 210C and is aligned with the second edge 182A of the first panel 100A.

The fourth panel 100D is secured to the three beams 210A, 210B, 210C in the manner described above using additional fastening devices 220. Additional panels 100 (not shown) are added as the construction progresses to complete the rows 230, 240 and to complete additional rows (not shown).

Figure 6:
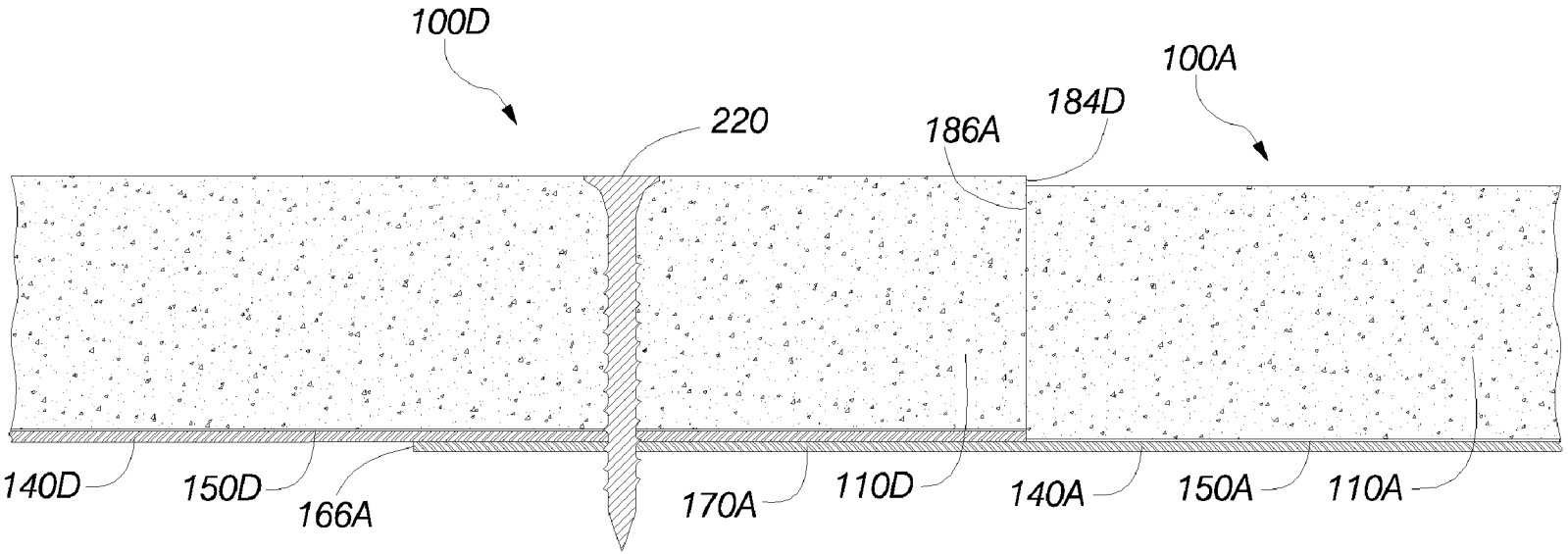
FIG. 6 illustrates an enlarged cross-sectional view taken along the lines 6-6 in FIG. 4 to illustrate the overlapping and mechanical interconnecting of the edge of one panel with the tab of an adjacent panel in the span between two beams.

As shown in FIG. 4 and as shown in more detail in the enlarged cross section in FIG. 6, the third edge 184D of the fourth panel 100D is positioned over the tab 170A of the first panel 100A so that the third edge 184D abuts the fourth edge 186A of the first panel 100A. When positioned as shown, a portion of the fourth panel 100D proximate the third edge 184D rests on the tab 170A. Additional fastening devices 220 pass through the first and second layers 110D, 140D of the fourth panel 100D and engage the tab 170A. When the fastening devices 220 are tightened, the tab 170A of the first panel 100A forms a secure, fire-resistant seal against the lower surface 144D of the fourth panel 100D. Furthermore, the secure interconnection of the two panels 100A, 100D effectively forms a continuous diaphragm spanning the two panels. Although the thickness of the tab 170A of the first panel 100A effectively raises the end of the fourth panel 100D, the thickness of the tab 170 on each panel 100 is generally less than about 5 percent of the overall thickness of the respective panel. Thus, the additional thickness of the tab 170A does not significantly affect the flatness of the floor or roof, particularly since other construction materials or finish materials cover the panels before the building is occupied. In particular, the pattern 200 of the panels 100 forms an underlayment (e.g., subfloor) over which additional flooring material, such as, for example, lightweight concrete flooring, gypsum cement flooring, hardwood flooring, flooring tile, carpeting, or the like, is installed to obtain a finished floor. Alternatively, the pattern 200 of panels 100 forms an underlayment for tiles, shingles or other roofing material.

When all the panels of the floor or roof underlayment system are interconnected in the illustrated manner to complete the pattern 200, the continuous diaphragm resists shear forces in the horizontal plane of the floor or roof, such as, for example, lateral forces caused by earthquakes or high winds. Furthermore, since the thin second layers 140 of the panels 100 are bonded to the respective first layers 100, the second layers 140 are secured to the beams 210 by the fastening devices 220 when the installation is completed. Thus, any permanent or transient loads applied to the panels in the areas between the beams 210 would have to bend the second layers 140 in order to fracture the first layers 110. Any tendency to bend the second layers 140 is inhibited by the tensile strength of the galvanized steel or other high-strength material that forms the second layers 140. Thus, such loads do not cause any significant vertical movement of the spanning portions of the panels 100 that would fracture the first layers 110.

Even if the first layer 110 of a panel 100 is fractured by the impact of a dropped heavy object, any such fracture would not penetrate the high-strength material of the second layer 140. Thus, the fracture would be constrained by the second layer 140 of the particular panel 100 and would not affect the efficacy of the diaphragm formed by the second layers 140 of the panels 100 in the flooring or roofing system.

Figure 7:
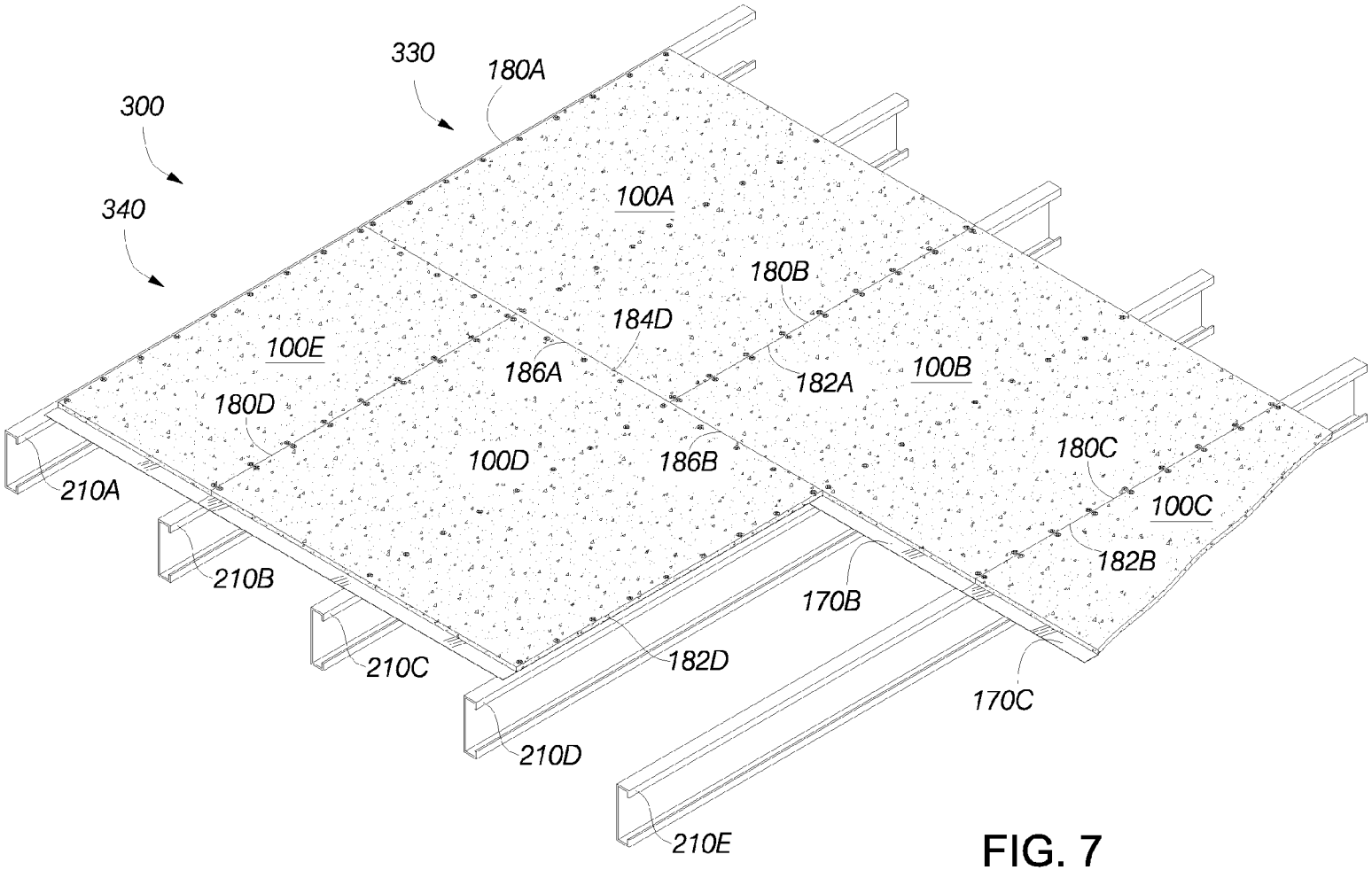
FIG. 7 illustrates a perspective view of an exemplary floor or roof of a building under construction, which illustrates a plurality of the panels of FIG. 1 positioned on the beams in a second pattern in which the seams between the panels in a direction perpendicular to the beams are aligned and the seams between the panels in the longitudinal direction of the beams are staggered.

FIG. 7 is a perspective view of an exemplary floor or roof of a building under construction, which illustrates a plurality of the panels 100 of FIG. 1 positioned on the beams (e.g., floor joists or roof rafters) 210 in a second pattern 300. The second pattern 300 has a first row 330 of panels 100A, 1008, 100C and has a second row 340 of panels 100 than includes a panel 100D and a partial panel 100E. As in the pattern 200, the tabs 170 of the adjacent panels 100A, 1008, 100C in the pattern 300 are aligned so that the seams formed between the fourth edges 186 of the panels 100 in the first row 330 and the third edges 184 of the panels 100 in the second row 340 are aligned in the direction perpendicular to the beams 210. The first edge 180D of the panel 100D in the second row 340 of the pattern 300 is staggered with respect to the first edge 180A of the panel 100A in the first row 330. In particular, the panel 100D is positioned in the second row 340 of the second pattern 300 with its first edge 180D positioned approximately on the longitudinal centerline of the second beam 210B rather than on the first beam 210A so that the longitudinal seam along the third beam 210C only extends for the length of the first panel 100A before being interrupted by the fourth panel 100D. The seam formed between the fourth panel 100D and a fifth panel 100E also extends only for the length of one panel.

Because of the offset of the first edge 180D, only a first portion (e.g., approximately one-half) of the third edge 184D of the panel 100D abuts the fourth edge 186A of the panel 100A. A second portion of the third edge 184D of the panel 100D abuts the fourth edge 186B of the panel 100B.

In the embodiment illustrated in FIG. 7, the longitudinal seams between the panels of a third row (not shown) and every second row thereafter are aligned with the longitudinal seams of the panels in the first row. In another embodiment (not shown) with beams spaced apart by 16 inches (40.64 centimeters), the longitudinal seams are aligned in every third row.

In some applications, staggering of the longitudinal seams illustrated in FIG. 7 further interlocks the panels 100 and may increase the shear strength of the overall floor or roof diaphragm.

Figure 8:
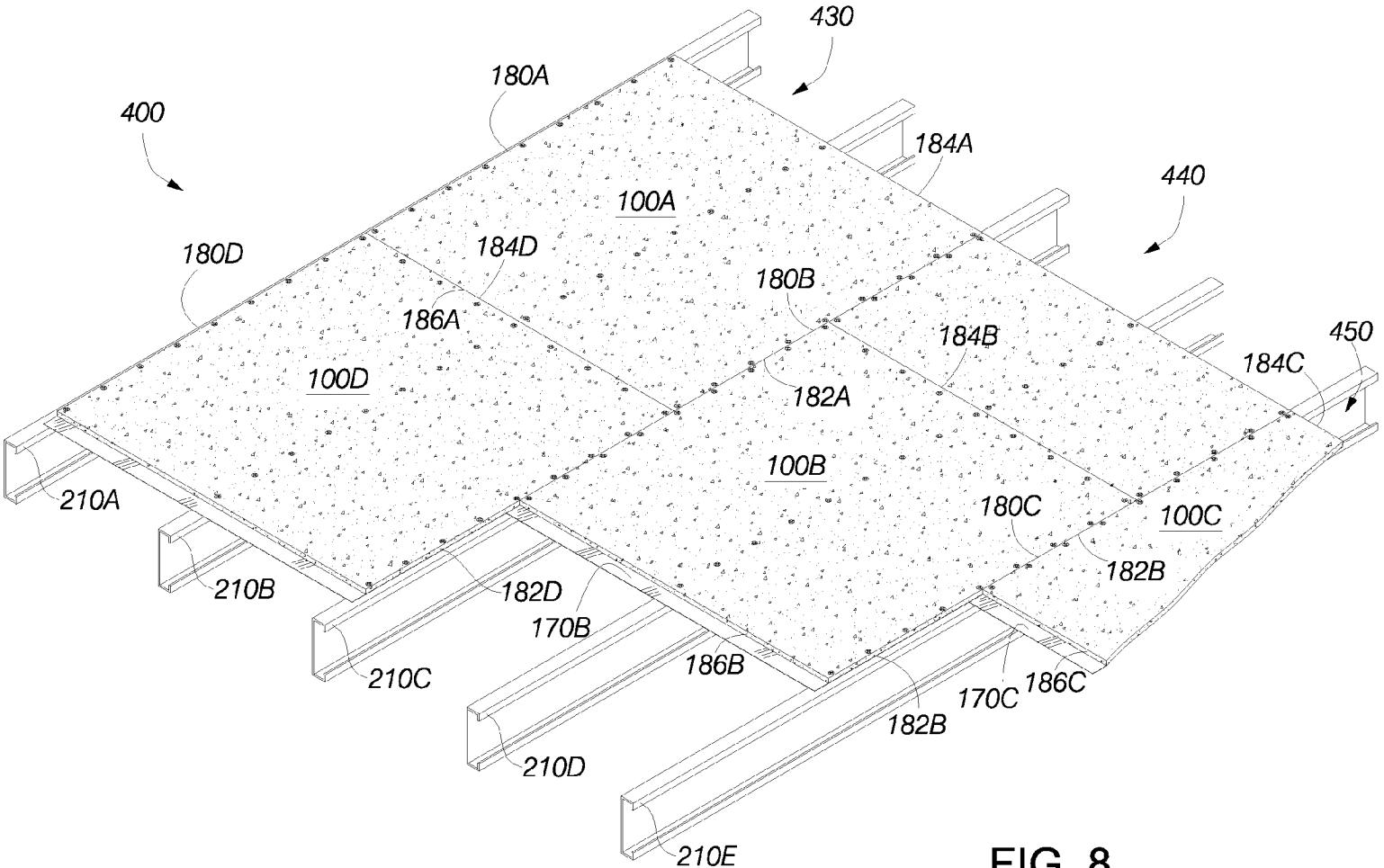
FIG. 8 illustrates a perspective view of an exemplary floor or roof of a building under construction, which illustrates a plurality of the panels of FIG. 1 positioned on the beams in a third pattern in which the longitudinal seams between adjacent panels along the beams are aligned and the seams perpendicular to the beams are staggered.

Additional installation patterns may also be incorporated. For example, in a third installation pattern 400 shown in FIG. 8, the seams formed between the third edges 184 and the fourth edges 186 are staggered by offsetting the longitudinal positions of the second panel 100B and other panels (not shown) in a second column 440 with respect to the first panel 100A and the fourth panel 100D in a first column 430. In particular, the third edge 184B and fourth edge 186B of the second panel 100B are displaced from the corresponding third edge 184A and fourth edge 186A of the first panel 100A by approximately one-half the length of the panels. In FIG. 8, the third edge 184C and the fourth edge 186C of the third panel 100C in a third column 450 are aligned with the corresponding third edge 184A and fourth edge 186A of the first panel 100A. In other embodiments, the panels in adjacent columns are advantageously staggered by different distances (e.g., one-fourth of the panel length).

One skilled in art will appreciate that the foregoing embodiments are illustrative of the present invention. The present invention can be advantageously incorporated into alternative embodiments while remaining within the spirit and scope of the present invention, as defined by the appended claims.

I claim:

1. A method for constructing a fire-resistant and shear-resistant diaphragm on the floor or roof of a building comprising:

positioning a first rectangular shear panel on a first set of at least three beams, the first shear panel having a width selected to correspond to a multiple of a center-to-center spacing of the beams, the first shear panel comprising a layer of fire-resistant cementitious board having an exposed first surface and having a second surface bonded to a layer of high-strength material, the layer of fire-resistant cementitious board having a first length between a respective first edge and a respective second edge, the layer of high-strength material having a second length between a respective first edge and a respective second edge, the second length of the layer of high-strength material greater than the first length of the fire-resistant cementitious board, the respective second edge of the layer of high-strength material extending beyond the respective second edge of the layer of fire resistant cementitious board to form a tab in the same plane as the high-strength material;

positioning a second rectangular shear panel substantially identical to the first rectangular shear panel on a second set of at least three beams, at least two beams of the second set of beams being in the first set of beams, at least an overlapping portion of the second shear panel proximate the first edge of the second shear panel being positioned on the tab of the first shear panel;

securing the first shear panel to the first set of beams with the second edge of the first shear panel generally perpendicular to the each beam of the first set of beams;

securing the second shear panel to the second set of beams; and securing the overlapping portion of the second shear panel to the tab of the first shear panel between the at least two of the beams of the second set of beams that are also in the first set of beams.

2. The method as defined in claim 1, wherein the at least two beams in the second set of beams correspond to two beams in the first set of beams, and one beam in the second set of beams is not in the first set of beams.

3. The method as defined in claim 2, wherein:

the width of each of the first rectangular shear panel and the second rectangular shear panel is defined between a respective third edge and a respective fourth edge;

the first rectangular shear panel is positioned with the respective first edge of the first rectangular shear panel on a first beam of the first set of at least three beams; and the second rectangular shear panel is positioned with the respective first edge of the second rectangular shear panel on a second beam of the first set of at least three beams such that the first edge of the second rectangular shear panel is offset from the first edge of the first edge of the first rectangular shear panel by the center-to-center spacing of the beams.

4. The method as defined in claim 1, wherein the first set of at least three beams and the second set of at least three beams comprise the same three beams.

5. The method as defined in claim 4, wherein:

the width of each of the first rectangular shear panel and the second rectangular shear panel is defined between a respective third edge and a respective fourth edge;

the first rectangular shear panel is positioned with the respective first edge of the first rectangular shear panel on a first beam of the first set of at least three beams; and the second rectangular shear panel is positioned with the respective first edge of the second rectangular shear panel also on the first beam of the first set of at least three beams such that the first edge of the second rectangular shear panel is aligned with the first edge of the first edge of the first rectangular shear panel.

* * * * *